United States Patent [19]

Bailey et al.

[11] 4,004,127

[45] Jan. 18, 1977

[54] ON LINE FUSING SYSTEM

[75] Inventors: John M. Bailey, Fairport; Raghulinga R. Thettu, Webster, both of N.Y.

[73] Assignee: Xerox Corporation, Stamford, Conn.

[22] Filed: Mar. 2, 1976

[21] Appl. No.: 663,025

[52] U.S. Cl. ..... 219/216; 219/388; 250/319

[51] Int. Cl.[2] ..... H05B 1/00; G03G 15/20

[58] Field of Search ..... 219/216, 388; 355/3 FU; 250/317–319; 432/59, 227

[56] References Cited

UNITED STATES PATENTS

| | | | |
|---|---|---|---|
| 3,903,394 | 9/1975 | Mullen | 219/216 |
| 3,935,424 | 1/1976 | Donnelly et al. | 219/216 |

*Primary Examiner*—C. L. Albritton

[57] ABSTRACT

An apparatus for fusing toner images onto flexible support material in which the support material is transported in a path past a flash fusing lamp. The path is defined by an outer member and an inner member which guide the sheet past the flash fusing lamp. The inner member is made of a transparent material and the outer member is reflective. Warm air under pressure is used to advance the support material along its path and to crust the toner images facing inwardly toward the lamp to prevent offset and reduce energy requirements of the lamp to permanently fix the images to the support material.

6 Claims, 3 Drawing Figures

ON LINE FUSING SYSTEM

The invention relates generally to an on line fusing system for copiers and duplicators and in particular to an improved system for fusing toner images onto flexible support materials rapidly and efficiently.

In the xerographic process, a plate, generally comprising a conductive backing upon which is placed a photoconductive insulating surface, is uniformly charged and the photoconductive surface then exposed to a light image of an original to be reproduced. The photoconductive surface is caused to become conductive under the influence of the light image so as to selectively dissipate the electrostatic charge found thereon to produce what is developed by means of a variety of pigmented resin materials specifically made for this purpose which are known in the xerographic art as "toners". The toner material is electrostatically attracted to the latent image areas on the plate in proportion to the charge concentration found thereon. Areas of high charge concentration become areas of higher toner density while correspondingly low charge image areas become proportionally less dense. The developed image is transferred to a final support material, typically paper, and fixed thereto to form a permanent record or copy of the original.

Many forms of image fixing techniques are known in the prior art, the most prevalent of which are vapor fixing, heat fixing, pressure fixing or combinations thereof as described in U.S. Pat. No. 3,539,161. Each of these techniques, by itself or in combination suffer from deficiencies which make their use impractical or difficult for specific xerographic applications. In general, it has been difficult to construct an entirely satisfactory heat fuser having a short warm up time, high efficiency, and ease of control. A further problem associated with heat fusers has been their tendency to burn or scorch the support material. Pressure fixing methods, whether hot or cold have created problems with image offsetting, resolution degradation and producing consistently a good class of fix. On the other hand, vapor fixing, which typically employs a toxic solvent has proven commerically infeasible because of the health hazard involved. Equipment to sufficiently isolate the fuser from the surrounding ambient air must by its very nature be complex and costly.

With the advent of new materials and new xerographic processing techniques, it is now feasible to construct automatic xerographic reproducing apparatus capable of producing copies at an extremely rapid rate. Radiant flash fusing is one practical method of image fixing that will lend itself readily to use in a high speed automatic process as described in U.S. Pat. No. 3,529,129. The main advantage of the flash fuser over the other known methods is that the energy, which is propagated in the form of electromagnetic waves, is instantaneously available and requires no intervening medium for its propagation. As can be seen, such apparatus does not require long warm up periods nor does the energy have to be transferred through a relatively slow conductive or convective heat transfer mechanism.

Although an extremely rapid transfer of energy between the source and the receiving body is afforded by the flash fusing process, a major problem with flash fusing as applied to the xerographic fixing art, has been designing apparatus which can fully and efficiently utilize a preponderance of the radiant energy emitted by the source during the relatively short flash period. The toner images typically constitutes a relatively small percentage of the total area of the copy receiving the radiant energy. Because of the properties of most copy material, as for example, paper most of the energy incident thereon is wasted by being transmitted through the copy or by being reflected away from the fusing area. Another disadvantage associated with the prior art flash fusing apparatus has heretofore been the non-uniformity of image fixing produced. This phenomena is primarily due to the fact that it is difficult to produce highly uniform irradiance on a large receiving surface as for example, a sheet of paper, from a relatively small source such as a flash lamp.

While considerable effort has been expended in providing schemes for enhancing the efficiency and uniformity of fix of electrographic flash fusing systems, most efforts have been directed toward the provision of specially contoured reflecting surfaces which are designed to at least partially surround the flashlamp and thereby conserve energy via multiple reflections as set forth in U.S. Pat. No. 3,529,129. In addition to being costly to fabricate, such reflecting surfaces tend to become contaminated by loose toner particles and thereby necessitate frequent cleaning operations.

The instant application is an improvement over the above described systems and in particular over the flash fusing system described in U.S. Pat. No. 3,903,394 commonly assigned herewith.

It is therefore an object of this invention to improve fusing of xerographic toner images.

Another object of the invention is to accomplish fusing of electrostatic images rapidly at reduced power levels.

Another object of the invention is to enable highly efficient fusing of toner images onto flexible support material.

For a better understanding of the invention as well as other objects and further features thereof, reference is had to the following description of the invention to be read in conjunction with the drawings wherein.

Figure 1:
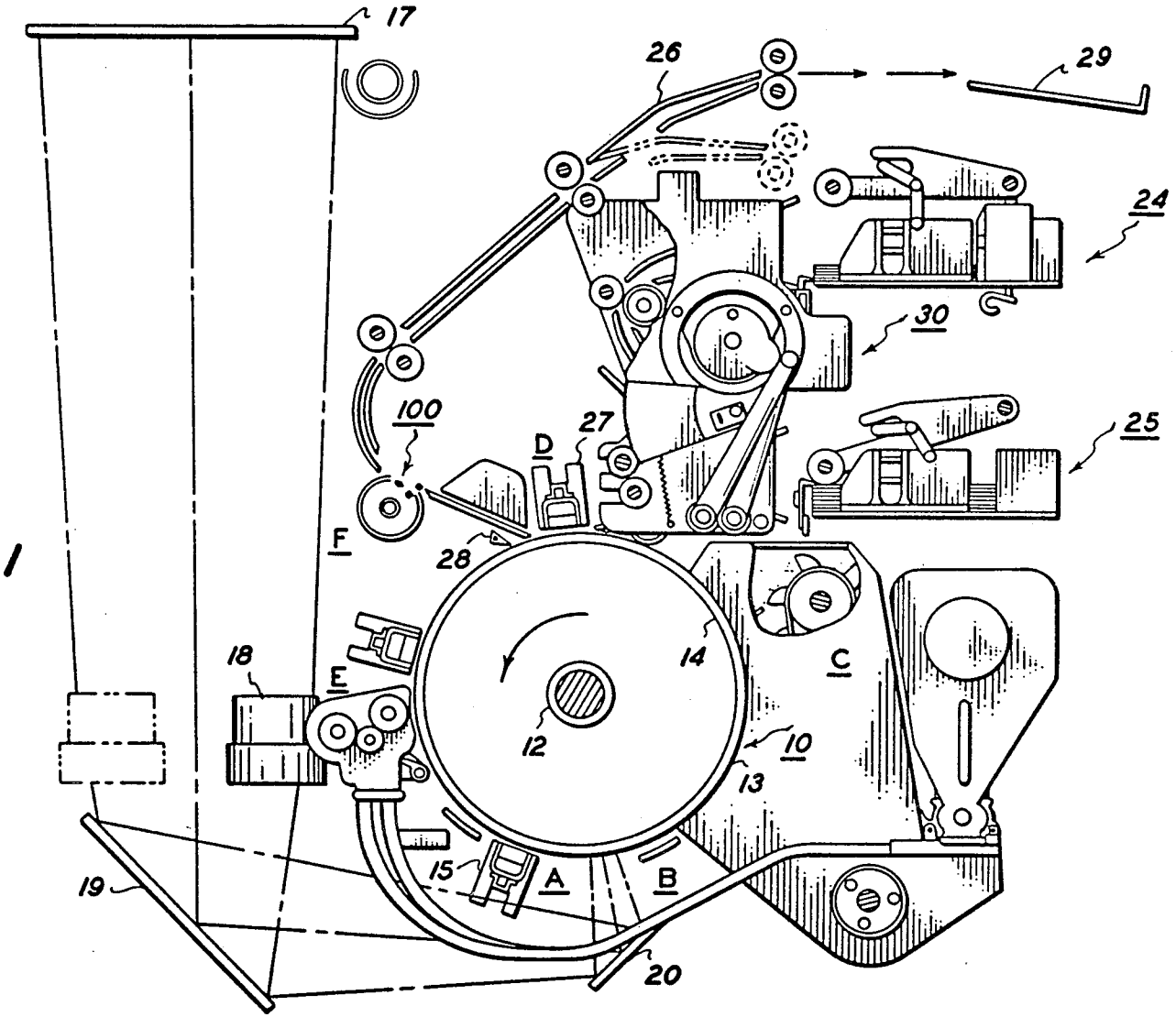
FIG. 1 is a schematic diagram illustrating xerographic apparatus embodying the on line fusing system of the invention.

Referring now to FIG. 1, there is illustrated a schematic representation of an automatic xerographic reproducing machine employing the on line fusing system of the present invention. It should be noted that while the apparatus of the present invention will be explained in conjunction with the reusable xerographic process; however, it should be clear to one skilled in the art that the apparatus of the present invention is not so limited and that the invention has wider application in any environment where it is desirous or necessary to permanently fix resinous toner particles onto a flexible support material.

Because the xerographic copying process is well known and used in the art, the processing steps herein employed will only be briefly described in reference to FIG. 1. Basically, the heat on the machine involves a photosensitive plate 10 which is formed in a drum configuration. The drum is mounted upon a horizontally aligned support shaft 12 and caused to rotate in the direction indicated so that the photosensitive plate passes sequentially through a series of processing stations. The drum shaped plate basically consists of an outer layer 13 of photoconductive material, such as selenium or the like that is placed over a grounded substrate 14.

In operation, the plate is initially charged to a uniform potential at a charging station A by means of a corona generator 15. The uniformly charged plate surface is then moved into an imaging station B wherein a flowing light image of the original document, which is supported upon a viewing platen 17 is projected onto the photoconductive plate surface by means of a moving scanning lens element 18 and a pair of mirrors 19 and 20. As a result of the imaging process a latent electrostatic image containing the original subject matter is recorded on the photoconductive plate surface.

The latent image is next transported on the drum through a developing station C wherein the latent image is rendered visible by the application of specially prepared charge toner particles which are cascaded over the image plate surface. The now visible toner image is then transported into the next subsequent processing station, an image transfer station D, wherein a sheet of final support material is fed from either one of two supply tray areas, an upper supply tray 24 and a lower supply tray 25, via a sheet registering and forwarding mechanism 30 in synchronous moving contact with the visible image carried on the plate surface. The support sheet and the charged toner image on the drum surface are moved together under a transfer corona generator 27 which serves to electrostatically transfer the toner images in image configuration from the drum surface onto the contacting side of the support sheet. The imaged sheet is then stripped from the drum surface by means of a pickoff finger 28 and directed along a stationary vacuum transport 29 towards fusing station F where the on line fusing system of the invention generally designated 50 for high efficiency rapid fusing of the toner image onto the support sheet as will be explained more fully hereinafter.

As noted above, the automatic copying device has the capability of producing either single sided copy, that is copy bearing a toner image on one side thereof or double sided copy. In a single sided mode of operation, the final support sheets are fed from either one of the two supply trays directly into the image transfer station via the sheet forwarding and registering mechanism 30. Upon the accomplishment of the transfer step, the image sheet is passed through and forwarded directly into a copy tray 29 where the copies are stored and held until such time as the machine operator removes them. On the other hand, when a two sided copying mode of operation is selected, movable transport 26 within the circular paper path, is lowered to the dotted line position as shown in FIG. 1 and the upper supply tray, which has previously been emptied of all support material is automatically prepared to accept a copy sheet directed therein. The copy sheets are then fed from the lower support tray to the image transfer station and the image fusing station directly into the upper support tray area where the sheets are stored until the machine is further programmed for a second run. Upon the initialization of the second copy run, the movable transport 26 is once again raised to solid line position as shown in FIG. 1 and the once imaged copy sheets are fed again directly from the upper supply tray through the transfer and fusing stations wherein a second image is created on the opposite or previously non-imaged side of the sheet. After fusing the two sided copy sheets are fed directly into a copy tray in the manner herein described above.

It is believed that the foregoing description is sufficient for purposes of the present application to show the general operation of a xerographic or electrostatographic reproducing machine. For a more detailed explanation of the components reference is made to U.S. Pat. No. 3,645,615 entitled Copying Apparatus.

Figure 2:
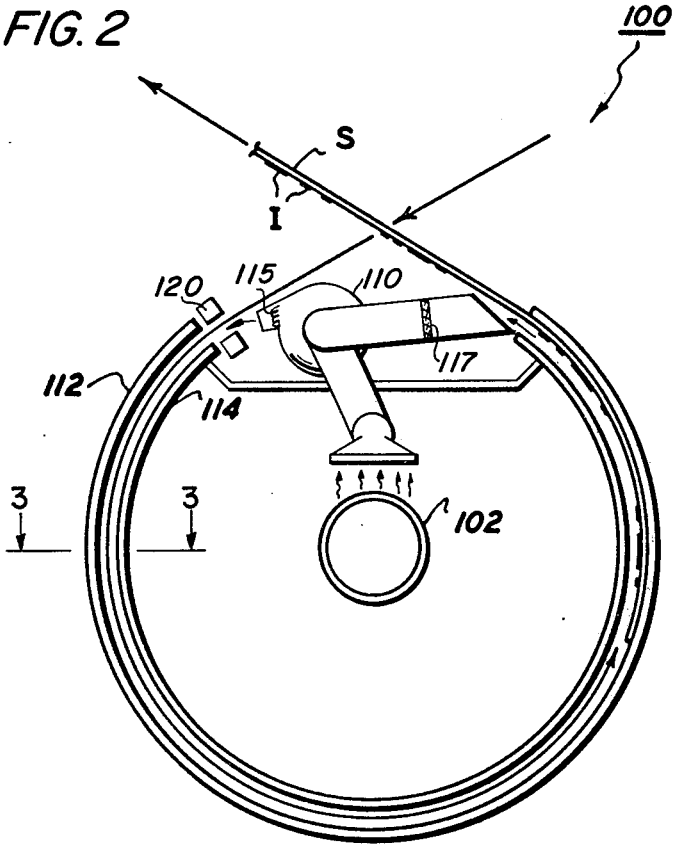
FIG. 2 is a detailed side view of the on line fusing system of the invention.
Figure 3:
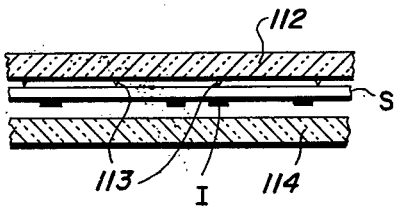
FIG. 3 is a cross-section view taken along line 3 — 3 of FIG. 2.

Referring now to FIGS. 2 and 3 in accordance with the present invention loose toner particles I carried on flexible support sheet S are fused thereto by initially crusting the toner particles with warm air used to transport the sheet and then permanently fixing the particles with radiant energy from a flash lamp. The sheet path is defined by cylindrically shaped members 112 and 114. Cylindrical member 114 is made of transparent material such as quartz so that the radiation from a flash lamp 102 is received on the images I carried on the sheet. Cylindrical member 112 desirably is coated with an aluminized mirror finish to reflect energy from the lamp back to the paper.

Cylindrical member 112 is formed with ridges 113 to facilitate the transport of the sheet S along the curved path past the flash lamp. Desirably the length of the path ground flash lamp 102 is approximately equal to the length of sheet S. The sheet S is moved along its path by warm air issuing from blower 110. The warm air is desirably at a temperature of from about 125° to about 175° F. As a result the images are crusted and thus do not transfer to the member 114. The warm air from blower 110 comes from the fuser cavity defined by the cylindrical members. An auxiliary heater element 115 located near the blower nozzle is used to heat the air during initial starting conditions until air from the flash lamp is sufficiently warm to crust the images. It will be appreciated that the control of element 115 is accomplished in a manner known by those skilled in the art. Desirably a filter 117 is used to collect any vapor matter generated during the flash operation. It will be appreciated that the warm air from blower 110 reduces the power from lamp 102 necessary to permanently fix the toner images to the sheet.

Flash lamp 102 is energized by a sensing member 120 which is positioned to sense the trailing edge of the sheet before completing the circular path defined by the cylindrical members 112 and 114. Alternatively the lamp can be energized by a timing circuit as is known by those skilled in the art.

It has been found that a Xenon flash lamp operating at power levels between 600 and 1200 Joules produced very good toner fusion. Pulse durations between 0.25 and 1.5 milliseconds were found to provide acceptable fusing with pulses between 0.5 and 1.2 milliseconds giving better fusing result. It has also been found that longer pulses of energy are required as the power level increases. Power input to the flash lamp 50 is provided by any suitable power supply such as a DC source with an adjustable voltage.

Above is described an improved on line fusing system capable of handling and transporting unfused copy sheets which achieves low thermal mass fusing with no external moving parts. Due to image crusting of the unfused images there is no image offset onto the wall contacting the images prior to permanent fixing thereof. Furthermore fixing is accomplished rapidly and at reduced power levels.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. An on line fusing system for fusing toner images onto sheets produced by a copier/duplicator machine comprising:

a pair of closely spaced plate members defining a sheet path along which sheets bearing loose toner images are advanced, at least one of said plate members being made of material which is transparent to radiation, a flash lamp positioned to direct radiation towards said transparent plate member and sheet path at a predetermined time, and blower means for directing warm air under pressure at the inlet end of said plate members to transport the sheets along their path and crust the loose toner images on said sheets prior to said images receiving radiation from said flash lamps.

2. Apparatus according to claim 1 including sensing means for detecting a predetermined portion of said sheets to provide a signal to energize the flash lamp.

3. Apparatus according to claim 1 wherein said blower means draws in warm air in the vicinity of said flash lamp.

4. Apparatus according to claim 1 wherein said plate members define a cylindrically shaped path which is substantially the length of said sheet.

5. Apparatus according to claim 1 wherein said blower means has auxiliary heating means to effect proper crusting of the images at starting conditions.

6. Apparatus according to claim 1 wherein said blower means includes a filter element to filter vapors produced from fusing the toner images.

* * * * *